US005913739A

United States Patent [19]

Brenneisen

[11] Patent Number: 5,913,739

[45] Date of Patent: Jun. 22, 1999

[54] BALL-SUSPENDING DEVICE AND MODIFIED BALL

[76] Inventor: Scott Michael Brenneisen, 1250 E. Sierra Madre, Glendora, Calif. 91741

[21] Appl. No.: 08/811,260

[22] Filed: Mar. 4, 1997

[51] Int. Cl.[6] ..... A63B 69/00

[52] U.S. Cl. ..... 473/430; 473/417; 473/459

[58] Field of Search ..... 473/423, 429, 473/430, 417, 418, 449, 459

[56] References Cited

U.S. PATENT DOCUMENTS

| | | | |
|---|---|---|---|
| 3,397,885 | 8/1968 | Nash, Jr. | 473/418 |
| 3,897,950 | 8/1975 | Keller . | |
| 4,022,471 | 5/1977 | Keller . | |
| 4,161,313 | 7/1979 | Dickey | 473/449 |
| 4,352,494 | 10/1982 | Wells | 473/449 |
| 4,798,390 | 1/1989 | Dooley . | |
| 4,881,742 | 11/1989 | Hargreave . | |
| 4,948,150 | 8/1990 | Daly, Jr. et al. . | |
| 5,566,949 | 10/1996 | Gorden . | |
| 5,588,655 | 12/1996 | Slupskiy . | |

OTHER PUBLICATIONS

Brochure from Rip Tide Volleyball, Inc. *The Hoop Spike.*

Brochure from AA1, *Training Products for The Ultimate Circuit*, p. 14.

*Primary Examiner*—William H. Grieb

[57] ABSTRACT

A device for practicing striking a standard sports ball that also has means to be held against gravity and released upon sufficient impact. A ball contains means for both retaining and releasing itself from a mating pivotable, attachment arm that is generally downwardly supported to allow the ball to be suspended above the ground, be struck, released and propelled in a preferred downward trajectory, e.g. a volleyball spike. The ball is usually retained on a minor portion of the upper 75 percent (relative to vertical) of the outer surface of the suspended ball so that its propelled trajectory and the striker's path are essentially not hindered before, during and after the strike and release.

64 Claims, 7 Drawing Sheets

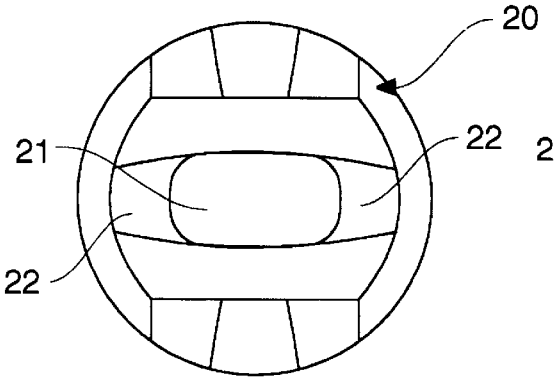
Fig. 2
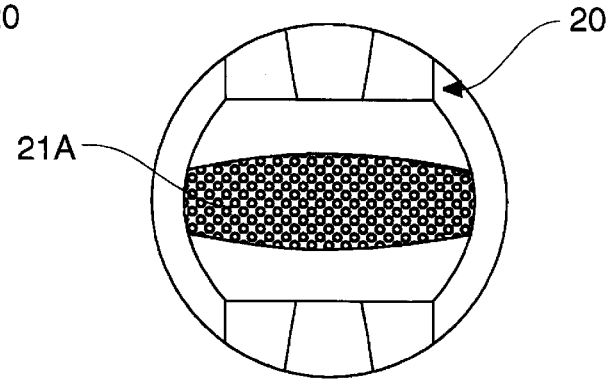
Fig. 2-B
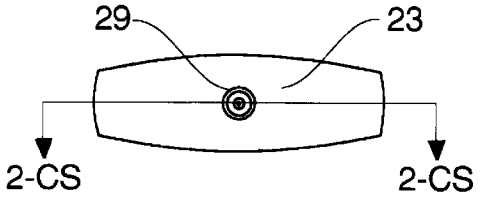
Fig. 2-C
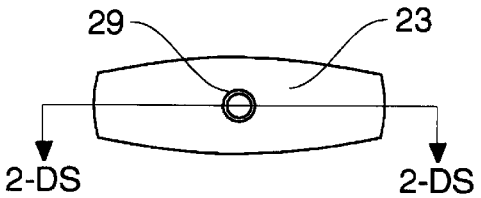
Fig. 2-D
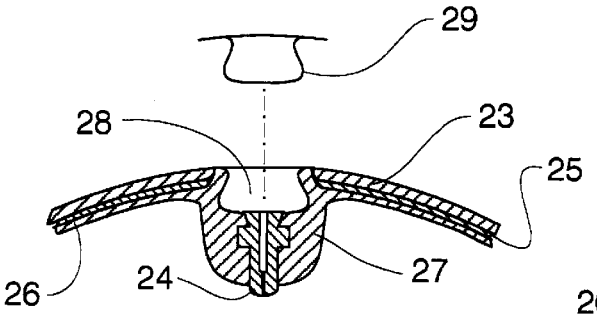
Fig. 2-CS
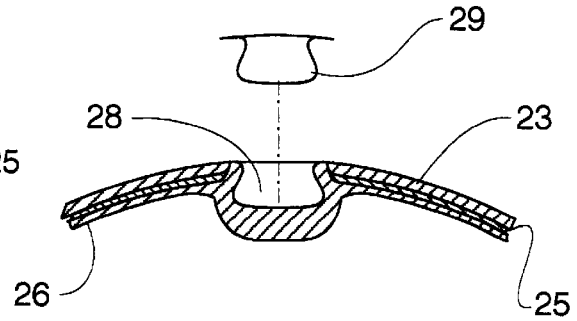
Fig. 2-DS 30
38
36
20
21
37
34
20
35
34H
12
30
33
32
10
31
Fig. 3-X

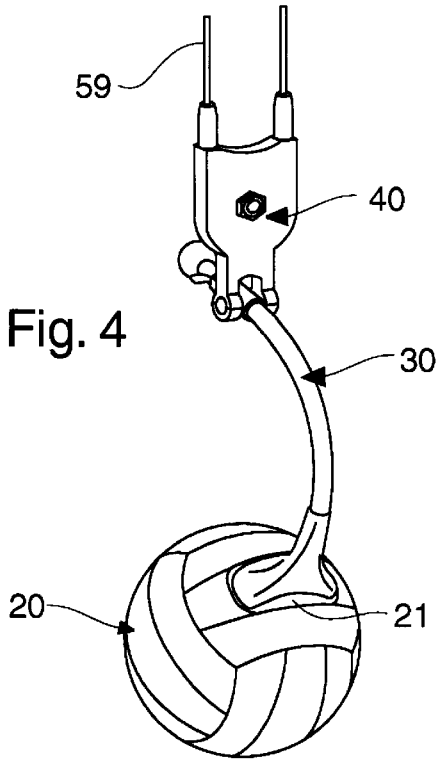
Fig. 4
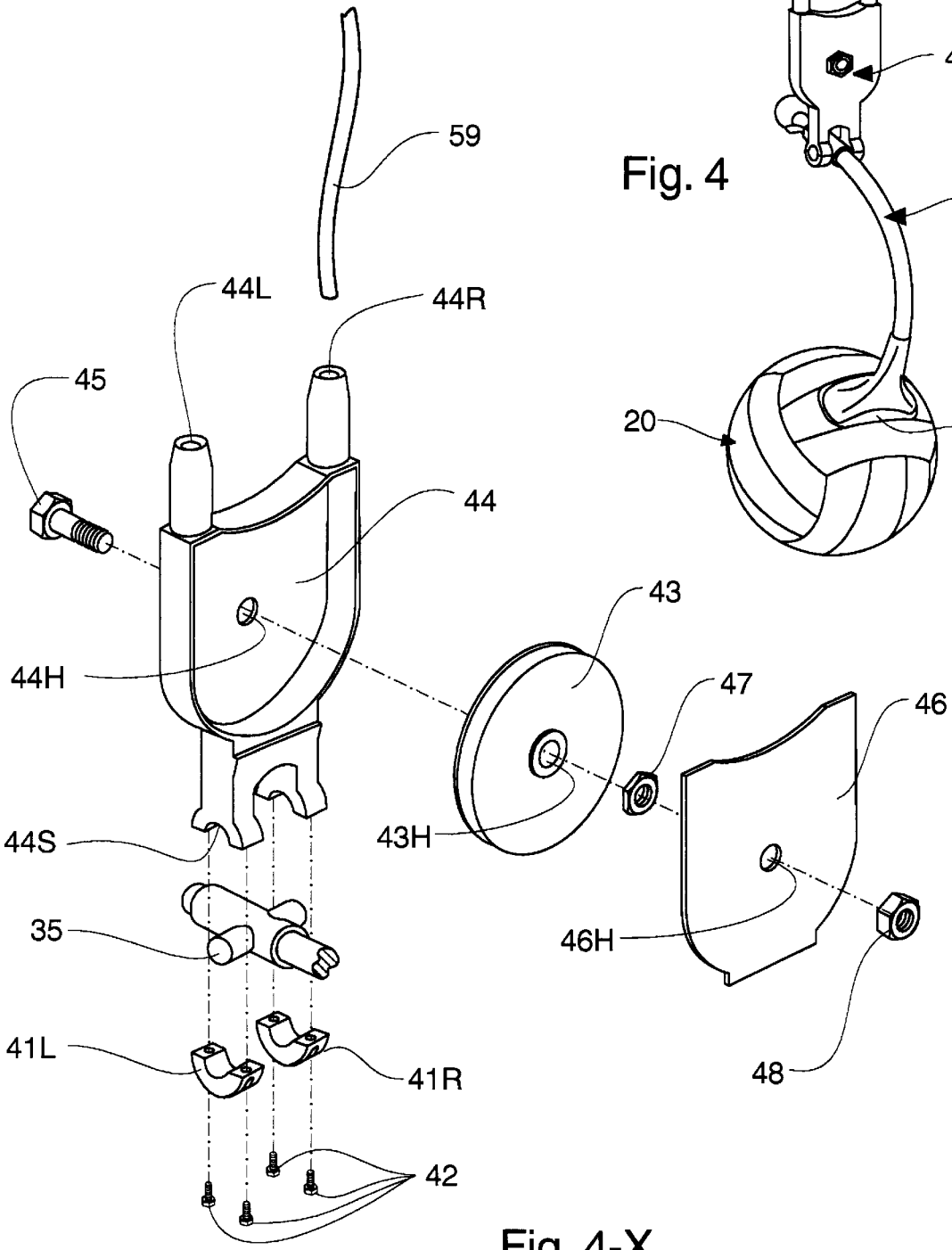
Fig. 4-X

BALL-SUSPENDING DEVICE AND MODIFIED BALL

BACKGROUND-FIELD OF INVENTION

This invention relates to sports employing a ball and, more particularly, to volleyball. More specifically, the invention relates to a new device for improving one's skills for hitting and/or spiking the ball.

BACKGROUND

One of the skills used in playing the game of volleyball is spiking. The art of spiking involves one player (a setter) projecting the ball into the air while another player (a hitter) strikes the ball forward and downward over the net into the opposing team's court. Spiking can be examined in three basic steps, the approach, jump, and swing. The approach often involves complicated footwork enabling a hitter to put his/her body in the most desirable position for contact of the ball. The jump involves planting both feet on the ground at the same time while rotating the arms backward then forward in a lunging motion to achieve maximum vertical leap. The swing will desirably contact the projected ball at the peak of one's jump with his/her arm filly extended while snapping the wrist over the top with sufficient force to cause the ball to spin forward and downward with great velocity. These three steps, coupled with the variable of projecting or setting the ball, are very difficult to learn. Consequently, it is beneficial to isolate the setting of the ball, allowing the hitter to concentrate and focus on the approach, jump, and swing. Hence, a need exists to suspend a volleyball in the air for practicing the art of spiking. A ball-suspending device must not compromise the hitter's safety and it should simulate actual play.

U.S. Pat. No. 4,948,150 to Daly, Jr. et al. (1990) discloses a device using a standard volleyball placed into a plastic mesh bag that is suspended by flexible tubing attached to a circular backboard. The commercially available Pro Spike Trainer by American Athletics Inc. of Jefferson, Iowa, closely resembles U.S. Pat. No. 4,948,150. Another U.S. Pat. No. 4,881,742 to Hargreave (1989) shows a device using a standard volleyball placed into a plastic mesh bag that is attached to semi-rigid tubing that rotates on a horizontal axle. The commercially available Hoop Spike by Riptide Volleyball of Yorksville, Ill., employs a four-legged strap that encompasses a standard volleyball. The four-legged strap is suspended from the top by a single strap that attaches to a horizontal backboard that is placed on a standard basketball rim. The Spike Master is another four-legged strap device that is commercially available from American Athletics Inc. of Jefferson, Iowa. Such a device encompasses a standard volleyball and the four-legged strap is suspended by two horizontal straps attached at opposite sides. Several of the above mentioned devices borrow techniques from the boxer's training device called a "speed bag" or a child's game called "tether ball". The speed bag is pivotably attached at the center of a circular horizontal backboard. The bag is hit with the arms rotating the fists about each other while rhythmically striking the front side. The game of tether ball consists of an eight foot pole having one end of a six foot rope tied to it's top and the other end tied to a playground ball. The game is played by striking the ball on the sides propelling it around the pole until the rope completely winds in-ending the game. Neither the attached tether ball nor the speed bag retaining devices are designed to be effectively hit over the top, i.e., striking at a downward angle from the point of attachment primarily on the upper hemisphere of the ball relative to vertical. Consequently, retaining a volleyball, for use as a hitting device, with mesh bags, straps, tubing, etc., creates several disadvantages. For instance, retaining the ball prevents the hitter from analyzing is/her progress through examination of ball trajectory and/or landing position within the playing field of the sport, e.g., volleyball court boundary or baseball foul lines; prevents the hitter from familiarizing himself/herself with correct contact; introduces the possibility of injury to the hitter by entanglement of his/her fingers or hand, or shock from a bat; requires a heavy base or strong frame members to distribute the force imparted by the hitter. Furthermore, such previously disclosed devices fail to meet important criteria—safety of the ball striker and realism of the ball's trajectory.

U.S. Pat. No. 3,897,950 to Keller (1975) and U.S. Pat. No. 4,798,390 to Dooley (1989) show a different approach whereby a volleyball is cradled from underneath on both sides, allowing the ball to be hit and released into the opposing court over its struck trajectory. While this method simulates a fair degree of realism, disadvantages are evident. First, the cradling device obstructs the swing path on opposite sides of the held ball presenting the possibility for injury to the hitter's hand and or arm, thus leaving little room for error when used by a beginner. Secondly, the frame types used for the cradle method do not facilitate easy reloading. To reload in the method of U.S. Pat. No. 3,897,950 one must lower the telescoping upper half of the device, place a ball in the cradle, and then raise the upper half to the desired height without disturbing the cradled ball. A step ladder may also be used. This device requires a second person to hold the frame at the upright to prevent tipping over. Finally U.S. Pat. No. 4,798,390 has a five ball dispenser for reloading the cradle quickly, but requires a ladder, which is awkward and time consuming.

Such prior art devices do not always provide sufficient safety while simulating actual play. While these devices simulate a degree of realism, they compromise the hitter's safety by obstructing the hand-arm swing path at the sides and the reloading methods of these devices do not facilitate an efficient workout. Also, there is one common element among all of the discussed prior art—they all use a standard volleyball, i.e., a non-modified volleyball.

Furthermore, in the sport of baseball or softball, one prior art practice device includes a tee supported upwardly from the ground with an upper end that cradles a standard ball at or very close to the bottom-most point of the lower hemisphere of the ball (relative to vertical), which allows the hitter to impact primarily the side surface of the ball. It is unusually difficult to propel the ball off the tee in a downward trajectory, such as hitting a "grounder," without hindering the hitter's swing path. Moreover, the tee provides no opportunity for the hitter to impact a moving ball. In any event, a need exists for devices that allow release of a moving or stationary ball upon impact accompanied by realistic trajectory of the propelled ball, yet still allow convenient loading, positioning and retainment of the ball prior to impact and reloading of another after impact.

SUMMARY OF THE INVENTION

Briefly, the invention includes a ball having an attachment fixture releasably attached to the ball that allows supported displacement of the ball. The attachment fixture includes means for the ball being retained and released from a generally downwardly hanging support having an area of attachment for attaching and detaching the ball. The ball is usually struck and released (and displaced) from a pivotable attachment arm connected to the support, while the ball is suspended above the ground or a floor against earth gravitational force. The arm attachment normally mates with the outer surface of the suspended ball at single or multiple area(s) of attachment, usually located on the upper 75 percent and preferably on the upper hemisphere of the ball (relative to vertical), but still a safe distance from contact by a ball striker—generally distal from the striking position. Usually during operation, the area of attachment (which can be a plurality of areas of attachment) in contact with the retaining means fixedly attached to the surface of the ball is located at least ten circumferential degrees from the ball striker's point of impact, i.e., a location generally distal from the striking portion—a distance providing sufficient safety for the hitter's swing path (including follow-through) to result in essentially no contact with the support or attachment arm.

Preferably, a volleyball is modified to contain a magnetic retaining means fixedly attached on a minor portion of its outer surface that allows the modified volleyball to be attached to and released from a mating portion of the pivotable arm attachment which pivots about the support. Magnets and other retaining materials must be of sufficient strength to hold the weight of the ball from falling to the earth or floor from the generally downwardly directed ball-attaching means associated with or connected to the support. The device of the invention can serve as a training device where a player (e.g., student spiker) strikes the retained volleyball in a pre-struck position with sufficient force to release the volleyball from the supported attachment arm to be displaced to a struck position and causing the attachment arm to pivot clear of the trajectory path of the volleyball and the player's striking path. The volleyball can be effectively propelled in a multi-directional manner at a velocity up to about 200 miles per hour (mph) by forces as small as a slight tap (i.e., sufficient to overcome the anti-gravitational force of the retaining means) up to about 350 pounds, i.e., that generated by heavy hitters. The device can be operated by adjusting the height of the point or area(s) of attachment for the ball (relative to the floor or to a ceiling) to provide convenient and rapid reloading of the ball during the course of multiple practice strikes. The pivotable attachment arm is raised and lowered by support means that may include a sheave assembly having the pivotable attachment arm pivoting about the lower end of the sheave assembly and flexible rope, cable, and the like, controlled in an tangle-preventing manner about the central and/or upper portion to adjust the height of the suspended ball for loading and striking. A preferred sheave assembly allows the pivotable attachment arm to pivot or rotate through at least a 360 degree arc, i.e., through a full circular arc that allows the ball-attaching end of the pivotable attachment arm to pass through an open central portion of the sheave assembly and continue around to return to its original position after ball impact and ball release.

Advantages of the present invention include providing a device that allows a hitter to analyze his/her progress through examination of ball trajectory and landing position within the playing field of the sport, e.g., a boundary of a volleyball court, providing a device that permits the hitter to familiarize himself/herself with correct impact of the ball within the contact zone, providing a device that allows the hitter to practice a variety of techniques with clear-unobstructed swing path, providing a device that is quickly and easily reloaded, and providing a device or method that can be used by as little as one player or hitter.

DESCRIPTION OF DRAWINGS

In the drawings, closely related figures and reference numerals have the same number but different alphabetic suffixes.

FIG. 2 shows a view of a volleyball.

FIGS. 2-B through 2-D show a variety of panels from a volleyball.

FIG. 2-CS shows an enlarged section view of a panel and the various layers of a volleyball taken along lines 2CS—2CS of FIG. 2-C.

FIG. 2-DS shows an enlarged section view of a panel and the various layers of a volleyball taken along lines 2DS—2DS of FIG. 2-D.

FIG. 3-X shows an exploded isometric view of an arm ass'y.

FIG. 4 shows an isometric view of a volleyball, an attachment arm ass'y, and a sheave assembly (used herein as "sheave ass'y").

FIG. 4-X shows an exploded isometric view of the sheave ass'y.

FIG. 5-A shows a fragmentary section view of FIG. 5 taken along lines 5A—5A.

FIGS. 9-A1, A2, A3 show a section view of FIG. 9 taken along lines 9A—9A.

FIG. 9-B shows an isometric view of the sheave ass'y of FIG. 9.

List of Reference Numerals

Figure 1:
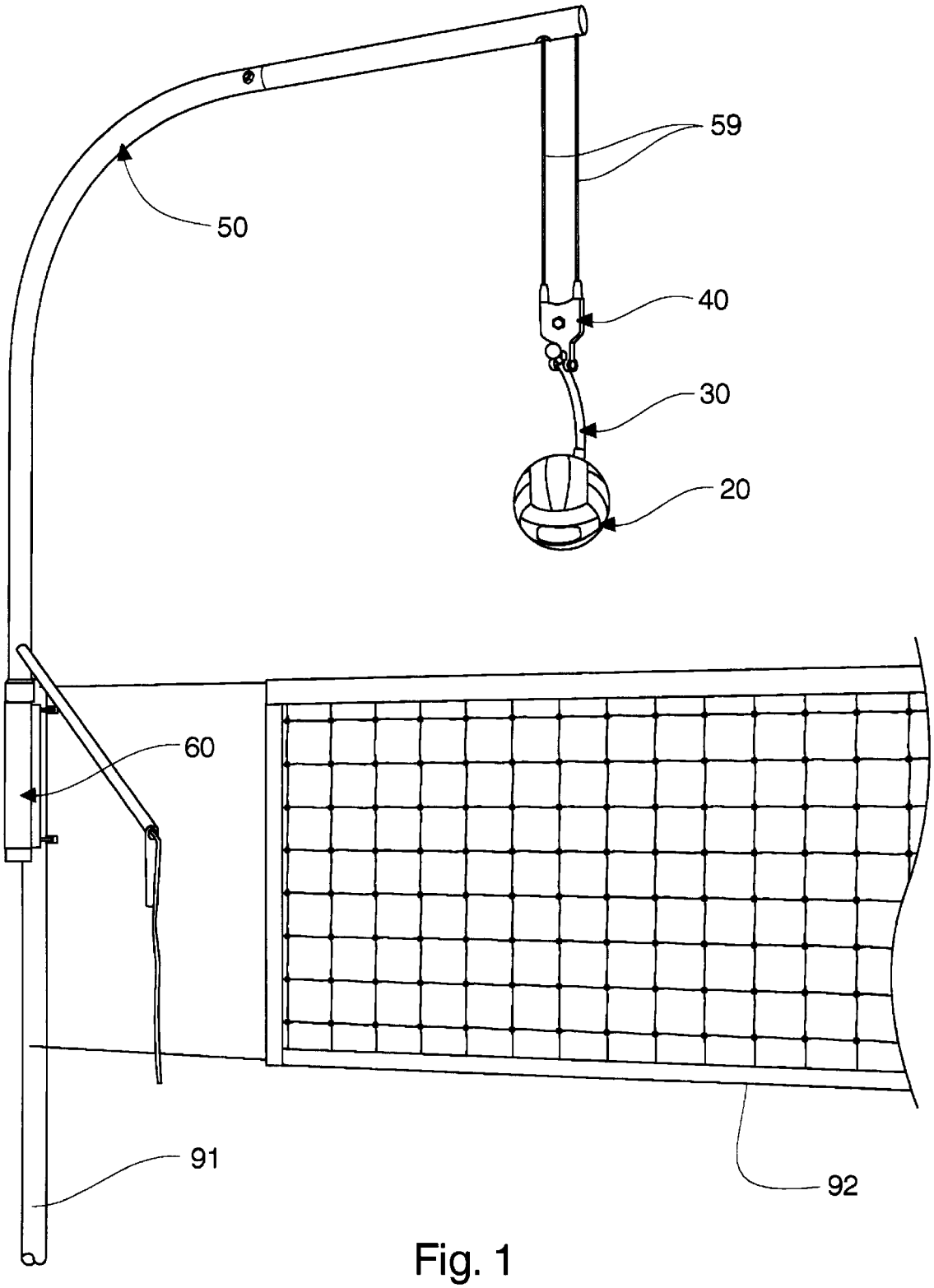
FIG. 1 shows a perspective view of a spike training device in position for use.

| | | | |
|---|---|---|---|
| 20 volleyball | 40 sheave ass'y | 50 frame ass'y | 60 mount ass'y |
| 21 magnetic panel | 41L clamp | 51 pulley | 61 bushing |
| 22 leather panel | 41R clamp | 51W washer | 62 sleeve |
| 23 leather panel w/hole | 42 screw | 51P hairpin cotter | 63 bracket |
| 24 air valve | 43 sheave | 52 top tube | 64 clamp |
| 25 canvas fabric | 43H hole | 52A hole | 65 nut & bolt |
| 26 bladder | 44 sheave enclosure | 52B hole | 70 sheave ass'y |
| 27 air valve housing | 44H hole | 52C hole | 72 sheave side enclosure |
| 28 orifice | 44L cord guide | 53 cap | 74 sheave side enclosure |
| 29 plug | 44R cord guide | 54 main tube | 76 upper sheave apparatus |
| 30 attachment arm ass'y | 44S cylindrical surface | 54A hole | 78 pulley |
| 31 plate | 45 hex bolt | 54B hole | 79 cord |
| 32 dampener | 46 cover plate | 54C hole | |

-continued

| List of Reference Numerals | | | |
|---|---|---|---|
| 33 arm | 46H hole | 54D hole | |
| 34 collar | 47 jam nut | 54E hole | |
| 34H hole | 48 hex nut | 55 collar | |
| 34L left orifice | | 56 handle | |
| 34R right orifice | | 57 cap | 91 net support pole |
| 35 pivot | | 58 latch | 92 volleyball net |
| 36 wing nut | | 59 nylon cord | 93 court boundaries |
| 37 all-thread | | 59U end of cord | 95 contact zone |
| 38 counter weight | | 59K knot | 96 contact zone |

DESCRIPTION OF THE PREFERRED DEVICE

Although, several different types of sports balls can be utilized in the invention, FIG. 1 shows the general nature of a preferred embodiment of the invention for practicing striking a volleyball, particularly spiking the ball, i.e., a spike trainer, which uses a training volleyball 20 adapted to be attached to and released from an area of attachment comprising attachment means such as pivotable attachment arm ass'y 30 which is pivotably connected to support means including a sheave ass'y 40 used to adjust the height of an attached ball above a floor. The floor can be the earth's surface, such as an outside dirt or sand ground surface or a wood, asphalt, concrete, etc. surface sometimes located indoors. The support means can include the sheave ass'y 40 being suspended by a nylon cord 59, and nylon cord 59 threaded through a plurality of pulleys, shown hereinafter in FIG. 5, within the support means such as a frame ass'y 50. Any conventional means for raising and lowering the ball can be utilized in place of the sheave ass'y, including other extensions of the support means. Frame ass'y 50 can be slid into a mounting ass'y 60, and mounting ass'y 60 can be attached to a pole 91 mounted in some fashion to a floor and often supports a net 92.

FIGS. 2 through 2-DS—Description of Volleyball

The typical ball modified and utilized in the invention can be any ball normally utilized during the practice or playing of a sport such as baseball, softball, basketball, soccer ball, tennis ball, and the like, and particularly a sports ball meeting the manufacturing standards for its intended sport and use. The preferred embodiment utilizes a volleyball. The typical volleyball's construction includes a spherical butyl-rubber bladder having an air valve laminated therein. A plurality of canvas fabric pieces are laid upon the bladder and attached at the valve core. Normally eighteen panels of genuine or simulated leather are then applied over the canvas fabric with an adhesive solution, creating the outer layer. The outer layer may also be stitched into the bladder. The typical volleyball's maximum outer circumference ordinarily measures between 25 and 27 inches, with a weight against the earth's gravitational force being in the range from about 6 to about 12 ounces when inflated within normal pressures, i.e., about four to about eight pounds of air pressure.

FIG. 2 shows a volleyball 20 which generally fits the above descriptions. A preferred embodiment of volleyball 20 uses simulated leather panels for durability and ball retaining means such as one or more flexible magnetic panels 21 fixedly attached to the volleyball. In general, the attachment fixtures of the volleyball include retaining means for holding and releasing the ball usually covering a minor portion of the whole outer surface of the ball. This attachment fixture usually encompasses less than 25 percent of the outer surface, i.e., a quadrasphere or less, and preferably less than about 10 percent of the outer surface, such as a panel of the ball. Panels 21 can be located on opposite sides of the ball. Panel 21 is applied to volleyball 20 with an adhesive solution and is centered between two simulated leather panels 22. The flexible magnets may be lighter or heavier than simulated or genuine leather, but are usually slightly heavier than the covering components of the volleyball. A one inch square by 1/16 inch thick flexible magnetic strip may weigh up to 10 times that of a simulated leather strip having the same dimensions. Therefore, it is beneficial to minimize the size of the flexible magnet so as not to grossly increase the standard weight of the typical volleyball (or other sports ball). Flexible magnetic strips are made by bonding a magnetic powder, as for example, Strontium, Barium Ferrite, and the like, in a flexible vinyl binder. The magnetism is provided by magnetic poles that generally run parallel to the length of the strip. The more poles per inch the stronger the magnetic hold when in contact with a mating, ball-attaching surface, such as an iron-containing surface, for example, a steel surface. Panel 21 may be pre-cut from flat strips by Magnet Sales and Manufacturing Inc. of Culver City, Calif. Panel 21, although generally of sufficient strength to hold the ball against falling to the earth due to its own weight, would preferably have at least four magnetic poles per inch on one side, be 1/16 inch thick, and have a surface area usually between about 1 and about 12 sq. inches, and preferably between about 3 and about 10 sq. inches. The above mentioned variables may be adjusted to achieve a desired or optimum ball-holding strength when attached to an area of attachment such as ball-attaching means on the pivotable attachment arm ass'y 30, as for example, a mating magnetic or metallic surface such as a steel plate 31 of the arm ass'y 30 shown hereinafter in FIG. 3-X. Magnetic panels 21 may be counter balanced by varying the bladder thickness and canvas fabric construction to strive for an essentially balanced sphere. Other attachment fixtures for the volleyball and other contemplated balls useful in the invention include retaining means such as hook and loop, suction cup, pneumatic cartridge and tube, hand-squeeze pump and tube, releasable tacky surface, forced-air levitation, snap fastener, plug and orifice, linear fastener and magnetic levitation.

Figure 3:
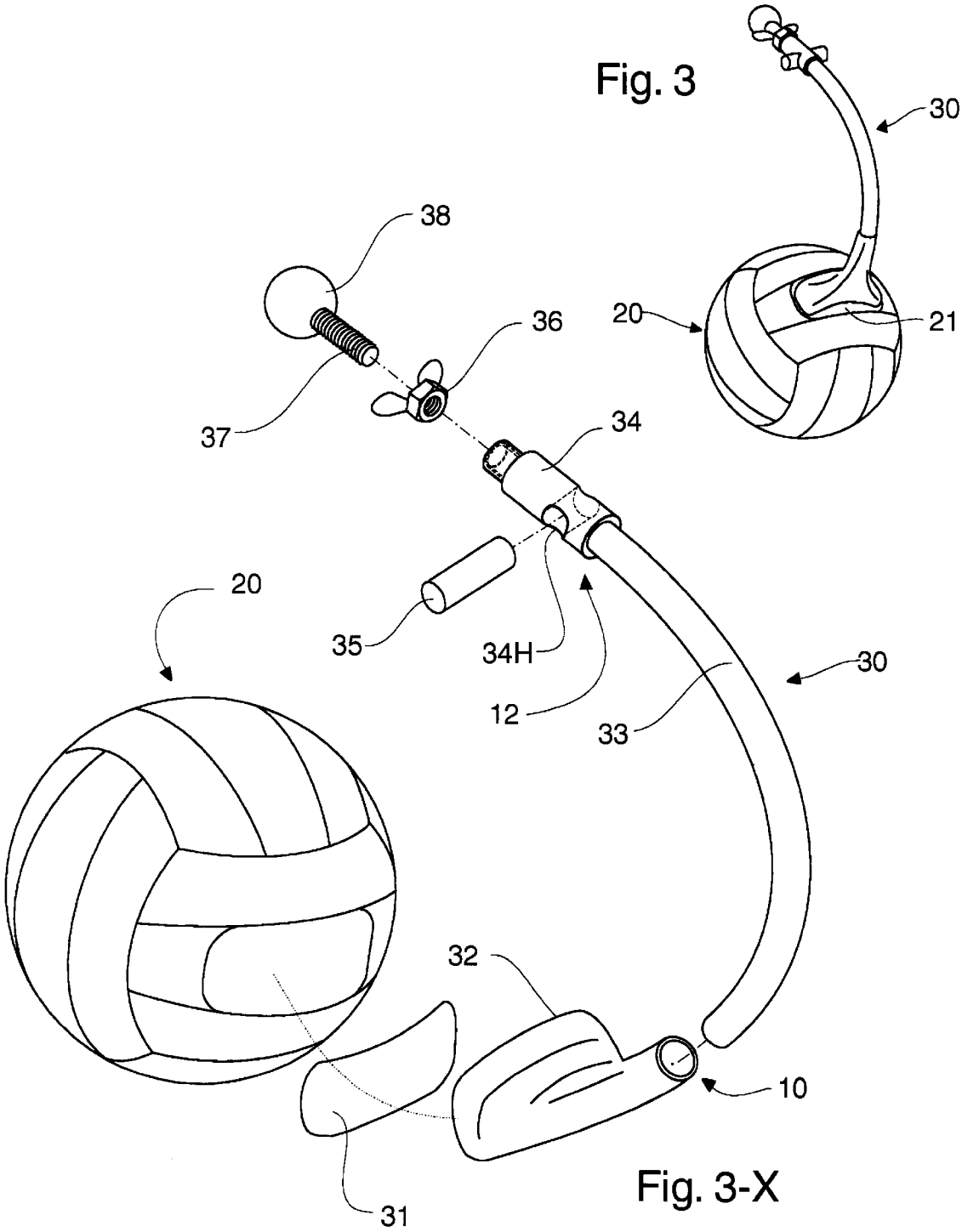
FIG. 3 shows an isometric view of a volleyball and an attachment arm assembly (used herein as attachment arm "ass'y").

In another embodiment, the releasable attachment of volleyball 20 may also be accomplished using any one of the following ball retaining means and attachment means. FIG. 2-B shows volleyball 20 that uses a hook and loop fastener combination. The loop side retaining means may occupy a panel 21A and be applied to volleyball 20 with an adhesive solution. The hook side can be located at the area of attachment, for example, replacing plate 31 (FIG. 3-X) at the ball-attaching end of pivotable arm attachment ass'y 30. FIG. 2-C shows another retaining means wherein a simulated leather panel 23 that has a hole cut out to expose an orifice 28. FIG. 2-CS shows an enlarged section view taken along lines 2-CS—2-CS of orifice 28 molded into a bladder 26 directly above an air valve 24 and an air valve housing 27. An attachment means comprising a mating plug 29 adapted to fasten to and release from orifice 28 can also replace ball attaching plate 31 (FIG. 3-X). FIG. 2-D shows yet another retaining means wherein leather panel 23 exposes orifice 28. FIG. 2-DS shows an enlarged section view taken along lines 2-DS—2-DS of orifice 28 molded into bladder 26 at the opposite side of valve 24, which would facilitate counter balancing of volleyball 20. The above retaining means and attachment means are suitable for holding and releasing volleyball 20, but the flexible magnet retaining means and the iron-containing attachment means at or about the area of attachment are preferred because of their low profile, excellent durability, easy loading, and superb release threshold. Due to the relatively rapid release of the ball from the ball-attaching means, particularly with magnetic materials and other low instant threshold releasing materials, the striker encounters minimal inertial forces during impact, thus encountering minimal resistance other than that of the ball itself. The retaining means fixedly attached to other sports balls and mating attachment means can be prepared in a similar manner utilizing specific means readily apparent to one skilled in the art for adapting the means for the particular ball.

FIGS. 3, 3-X—Description of Attachment Arm Ass'y

FIG. 3 shows an isometric view of volleyball 20 and an attachment arm ass'y 30. FIG. 3-X shows an exploded isometric view of volleyball 20 and attachment means including an attachment arm assembly 30 having a lower oriented ball-attaching means 10, an upper oriented pivotable means 12, and a connecting means, arm 33. The ball attaching means 12 in FIG. 3-X, shows steel plate 31, having a spherical surface matching (contouring) a minor portion of the outer surface of volleyball 20 at or about ball retaining means 21. Plate 31 can be integrally molded with a relatively flexible, shock absorbing material capable of withstanding incidental or accidental impacts due to a ball striker, particularly a part of a player hand or a bat, and the like. One example is a rubber dampener 32. Dampener 32 is attached with adhesive or other fastening means over the lower end of a vertically oriented connecting means, arm 33, that has an arc usually within the range from 100 to 150 degrees about a radius of 2 to 12 inches, for example, a 125 degree arc about a 5 inch radius. The upper end of arm 33 connects the lower ended ball-attaching means 10 to the pivotable means 12. In one embodiment of the pivotable means, arm 33 is slid through a reinforcing collar 34 until it extends beyond the opposite end of collar 34, the seams of which are then fillet welded the entire circumference at both ends of collar 34. A hole 34H is drilled through arm 33 and collar 34 perpendicular to arm 33. Hole 34H has a diameter such that it creates a slip fit for a pivot 35 (such as ¼–½ inch diameter) to be welded therein, thus forming a fulcrum portion of attachment arm ass'y 30 that pivots (such as by rotation) about a support. Counterbalancing means for balancing the weight of the volleyball for producing desired, predetermined suspension angles from vertical for the attached volleyball can be included in the attachment arm ass'y 30 by extending arm 33 past pivot 35. The inside diameter of the upper end of arm 33 has right-hand threads to receive one end of a piece of all-thread 37 with the opposite end of all-thread 37 having a rubber-coated lead counter weight 38 welded thereon. A wing nut 36 is threaded onto all-thread 37 between counter weight 38 and arm 33.

Plate 31 can be fabricated from relative thin iron-containing sheet metal plating, such as about 0.01 to about 0.05 inch thick steel, preferably having an area equal to or greater than that of magnetic panel 21. It is preferred that the ball-attaching surface, such as plate 31 be corrosive resistant, such as being treated by galvanization, painting, and the like. Dampener 32 is cast in a mold using neoprene rubber having a durameter hardness of about shore A: 35–45, which is soft to the touch of the hitter's fingers when impacted with moderate energy. Dampener 32 may also be cast of such relatively soft materials as natural rubber, butyl rubber, EPDM, or a polyurethane elastomer over a light-weight inner-core of materials such as fiberglass, plastic, or wood. The shape of dampener 32 can be transformed from that of plate 31 to form a relative match with arm 33. The combined weight of plate 31 and dampener 32 is usually less than about ⅓ of that of volleyball 20. The distance between plate 31 and pivot 35 is normally in the range from about 2 to about 16 inches, and preferably about 8 to about 12 inches. The connecting means can be flexible or rigid material, for example, arm 33, as well as a collar 34, are preferably fabricated using a metal-containing bar or tubing such as cylindrical aluminum tubing. Pivot 35 can be made with, for instance, plastics or solid metals, such as aluminum cylindrical stock. All such parts may also be made of injection molded plastic, machined plastic, hardwood, steel, or any type of composite material having the strength to endure the stresses they may receive. The weight of counterweight 38 is usually greater than that of the combination of plate 31 and dampener 32 but less than that of volleyball 20. A tension spring, positioned and attached between arm 33 and a receiving enclosure 44 (FIG. 4-X) for pivot 35 so as to equal the desired counterbalancing displacement, may also be used in place of counterweight 38.

FIGS. 4, 4-X—Description of Sheave Ass'y

FIG. 4 shows an isometric view of volleyball 20, pivotable attachment arm ass'y 30, and height adjustment means connectable to the remainder of the support comprising a sheave ass'y 40 for raising and lowering the height of pivotable attachment arm ass'y 30 from a floor. FIG. 4-X shows an exploded isometric view of sheave ass'y 40, pivot 35 (from FIG. 3-X) and a fragmentary view of arm 33. Pivot 35 is retained with a slip fit clearance between lower curved surface clamps 41L and 41R and an upper curved surface 44S which are fastened with a plurality of screws 42, thus forming a orifice within which pivot 35 can rotate. Alternatively, the orifice can be formed as a socket to allow a multi-directional pivot such as a sphere or ball shaped pivot (not shown) at the pivotable end 12 of pivotable attachment arm ass'y 30. A sheave 43 is held in an enclosure 44 with a hex bolt 45 inserted through a hole 44H, and a hole 43H, and fastened with a jam nut 47. A flexible string-type communicator such as nylon cord 59 is fed into a cord guide 44R around sheave 43 and exits a cord guide 44L. A cover plate 46 is placed onto the remaining extending threads of bolt 45 and fastened with a hex nut 48. Sheave 43, with roller bearings, is a conventional item having an appropriate groove width for cord 59. Other flexible string-like communicators such as wire, rope, chain, any type of strap, and the like, may be used in place of nylon cord 59. Enclosure 44, clamps 41L, 41R, and cover plate 46 in the preferred embodiment can be injection molded using light weight durable plastic, but may also be made of sheet metal, aluminum, plastic, hard wood, etc.

Figure 5:
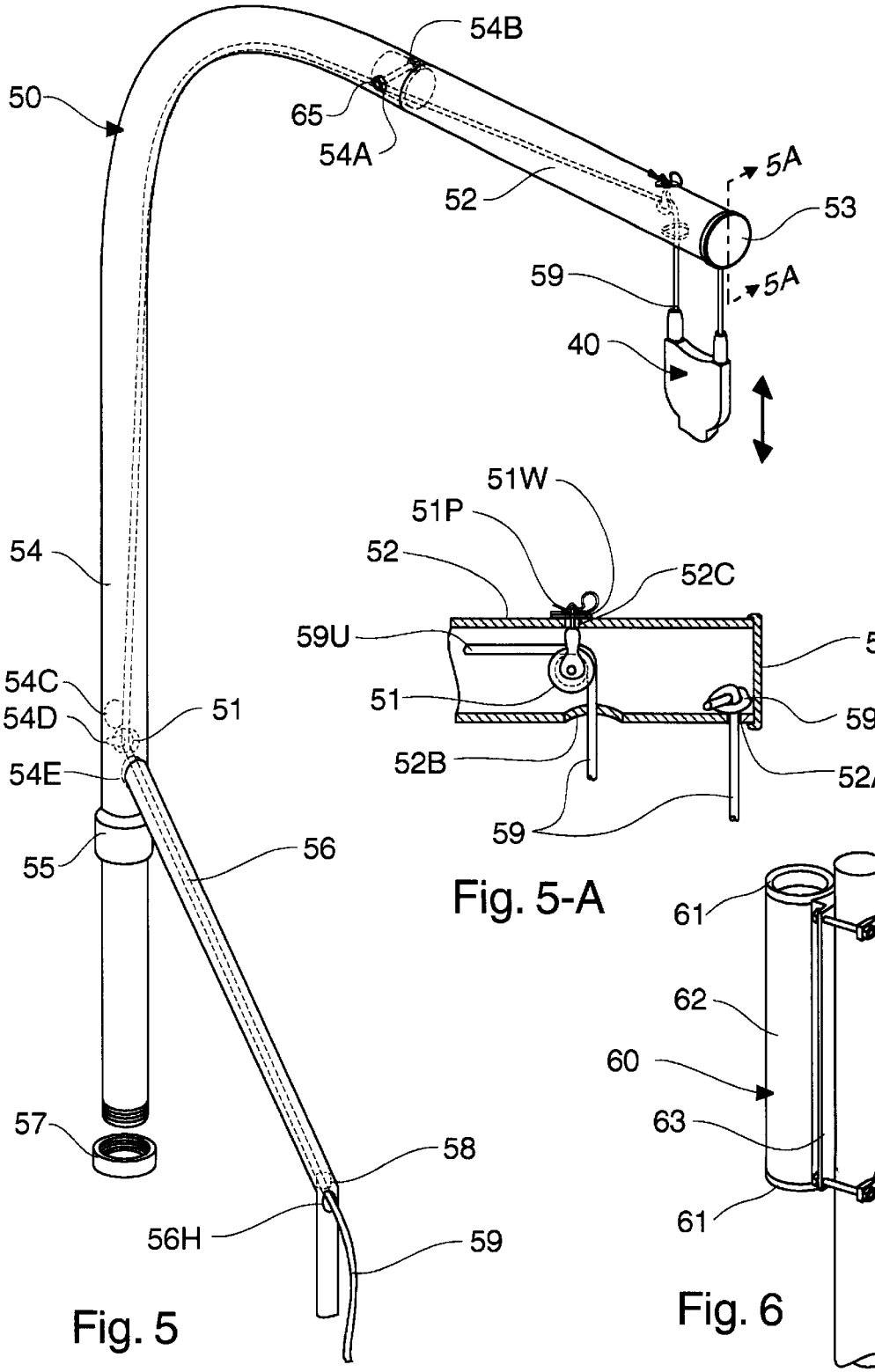
FIG. 5 shows an isometric view of a frame assembly (used herein as "frame ass'y").

FIGS. 5, 5-A—Description of Frame Ass'y

FIG. 5 shows an isometric view of support means including frame ass'y 50 and sheave ass'y 40. FIG. 5-A shows an enlarged section view taken along lines SA—SA of FIG. 5. FIG. 5-A shows a removable cap 53 that allows for the end of cord 59 to be fed through a hole 52A in a horizontally oriented tube 52, and a knot 59K tied to retain end of cord 59. An untied end 59U of cord 59 is slipped through a pulley 51. Pulley 51 is fed through hole 52B and partially fed through a hole 52C, then fastened in place with a washer 51W and a hairpin cotter 51P or other equivalent means. FIG. 5 shows end of cord 59U threaded through open end of tube 52 and fed downward into the curved end of a vertically oriented tube 54. Toward the lower end of tube 54, end of cord 59U is slipped through another, second pulley 51 that is fed through a hole 54C and partially fed through a hole 54D and fastened in the same manner as described in FIG. 5-A. End of cord 59U is then fed through a hole 54E into a preferably tubular handle 56, threaded through a string-tying means such as latch 58, and exits a handle 56 through a hole 56H.

Tube 52 is slid partially into tube 54 and fastened with a bolt and hex nut 65 through holes 54A and 54B. An aluminum collar 55 is slid over tube 54 about 12–18 inches from the lower end thereof, and the seams of which are fillet welded the entire circumference at each end. The lower end of tube 54 has male threads to mate with a cap 57 having female threads. Cap 57 can be mounted to a floor, post, mobile cart, etc., to allow rotation of tube 54. Handle 56 is secured to tube 54 in a hole 54E, that usually has a downward angle ranging from about 10 to about 90 degrees (preferably about 30 to 60 degrees) from vertical. Handle 56 is fillet welded in place the entire circumference of the seam. Tubes 52 and 54 preferably have an outside diameter of about 1.5 to about 4 inches with a wall thickness such that frame ass'y 50 members are rigid enough to suspend volleyball 20, arm ass'y 30, and sheave ass'y 40 (FIG. 1), with a minimum amount of deflection. Nylon or plastic tubing such as materials of PVC (polyvinyl chloride), CPVC, ABS, etc., and metal-containing tubing including materials such as aluminum, light steel, titanium, and the like, may be used for frame ass'y 50. Latch 58 employs a rack and pinion combination, of a type commonly used in horizontal window blinds.

Figure 6:
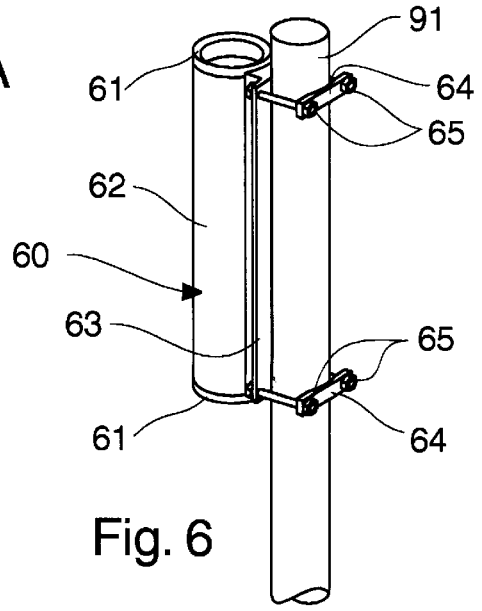
FIG. 6 shows an isometric view of a mounting assembly (used herein as "mounting ass'y") attached to a net support pole.

FIG. 6—Description of Mount Ass'y

FIG. 6 shows an isometric view of further support means including mount ass'y 60. A bushing 61 is inserted at each end of sleeve 62, and sleeve 62 is welded to a bracket 63. Bracket 63 is mounted by sandwiching pole support 91 with bracket 63 and clamps 64, then fastened with bolts and hex nuts 65. A sleeve 62 has an inside diameter for a slip fit with the lower end of tube 54.

Operation of Device

Whether the device of the invention is a spike trainer, batting trainer, basketball rebound or dunk trainer, and the like, it is adapted for its desired use with any type of sport playing field or sport court, such as a baseball diamond and outfield foul lines, volleyball court and net, basketball court and hoop, etc. and may also be attached to a variety of fixed posts, e.g. cylindrical or square-cross sectional posts.

The game of volleyball is played on a variety of surfaces including sand, grass, hardwood, etc. A typical court has a rectangular boundary of 30'×60'. A 3'×36' net bisects the length of the court into two opposing sides. The top of the net is tightly suspended eight feet above ground between two poles at opposite sides of the court. The height of the net varies with age and gender.

FIGS. 1, 3, 3-X, 5, 6, 10 Operation of Frame and Mount Ass'y

Figure 10:
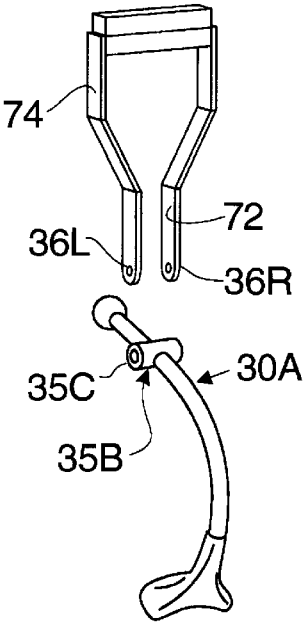
FIG. 10 shows a fragmentary plan view of a volleyball court's boundary.
Figure 10:
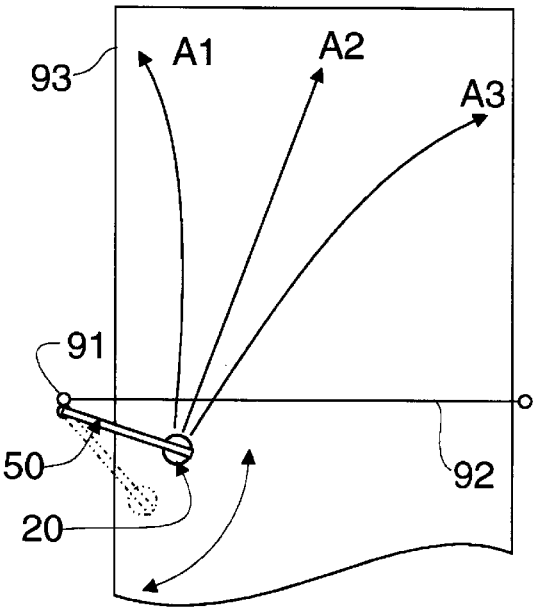

In one embodiment, the spike trainer is fastened to one of the two poles 91 supporting net 92 with mount ass'y 60 (FIG. 1). The lower end of frame ass'y 50 is slid into mount ass'y 60 and retained with threaded cap 57 (FIG. 5). Volleyball 20 (FIGS. 3, 3-X) is releasably attached to plate 31, of arm ass'y 30, with magnetic panel 21 which is fixed attached to volleyball 20. Volleyball 20 and arm ass'y 30 are vertically raised to desired position above net 92 by drawing cord 59 through a plurality of pulleys 51 within frame ass'y 50, through sheave ass'y 40, then securing cord 59 with latch 58 (FIG. 5). FIG. 10 shows volleyball 20 may also be positioned about net 92 by rotating frame ass'y 50 about a vertical axis of support 91 using handle 56. Bushings 61 at each end of sleeve 62 (FIG. 6) permit frame ass'y 50 to rotate easily with very little friction. After attachment of the ball and arrangement of the desired position, the hitter may practice the basic fundamentals of spiking. To reload volleyball 20 the hitter releases cord 59 from latch 58 allowing gravity to lower pivotable attachment arm ass'y 30 via sheave ass'y 40. Volleyball 20 may then be reattached to pivotable attachment arm ass'y 30.

FIGS. 7, 8, 9, 10—Operation of Pivotable Attachment Arm Ass'y

Figure 7:
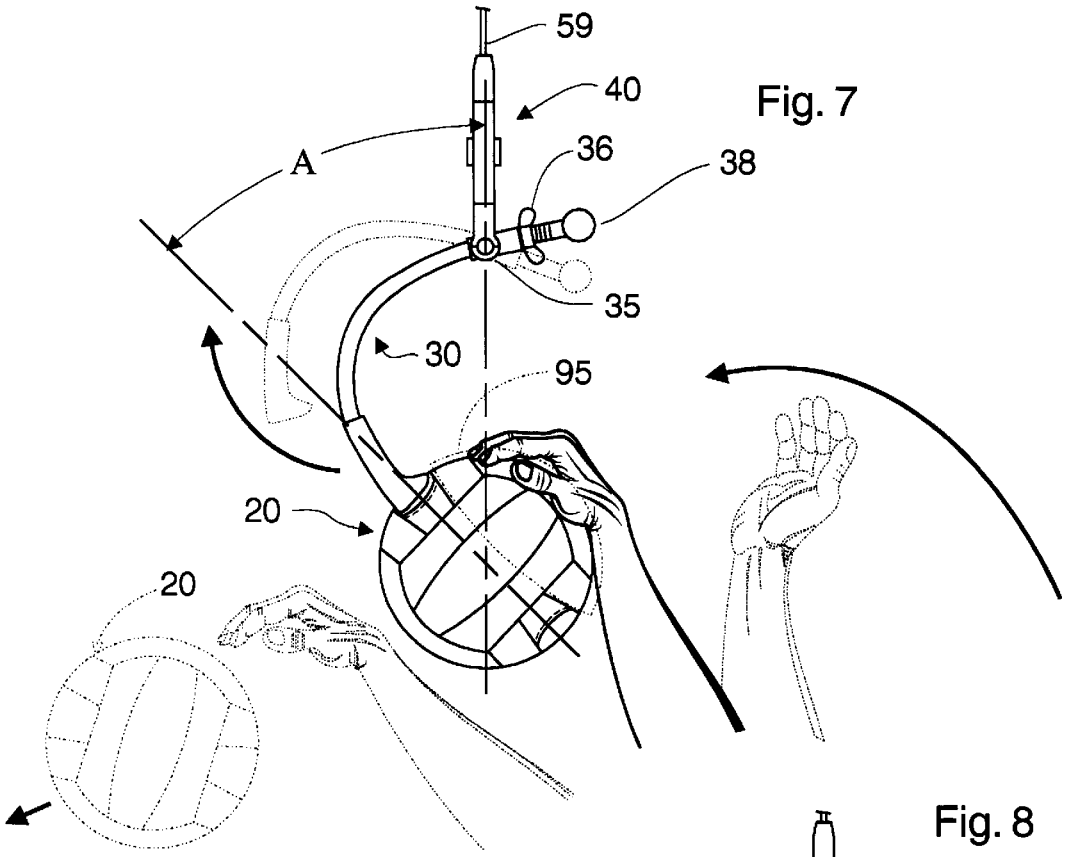
FIG. 7 shows a side view of a volleyball, an attachment arm ass'y, and a sheave ass'y, including a volleyball striker's hand and volleyball displacement.

FIG. 7 illustrates how the unique configuration of pivotable attachment arm ass'y 30 facilitates a safe and realistic-feeling during a player's impacting of the sports ball. As the hitter impacts volleyball 20, the ball is released from pivotable attachment arm ass'y 30 at plate 31, i.e., at the area of attachment. After the ball is detached from the pivotable attachment arm, the pivotable arm 33 pivots upward, clearing the way for the hand-arm swing path. Rubber dampener 32, serves two purposes; to control and dampen the releasability of panel 21 from plate 31, and to protect the hitter's fingers or hand from injury by preventing contact with steel plate 31 or arm 33. Arm 33 serves as the vertical pivot member with which dampener 32 and plate 31 are held in place, suspending volleyball 20. Reinforcing collar 34 adds material and strength to the upper end of arm 33 for pivot 35. The length and curvature of arm 33 facilitates an unobstructed swing path when approaching volleyball 20. Counterweight 38, locked in place with wing nut 36, is urged downward about pivot 35 by gravitational forces, thereby removing plate 31 and dampener 32 from the continuing swing path beyond the initial position of volleyball 20.

In the invention, volleyball 20 (or any other ball used in the invention) is suspended from about the area of attachment in connection with the support means, preferably at or about the centroid of the area of attachment of the ball-attaching means of pivotable attachment arm ass'y 30, at a predetermined suspension angle formed by the intersection of a central ray of an attached ball passing outwardly through both the centroid of the area of attachment and the centroid of the retaining means on the ball with the vertical central ray of the attached ball. Such a predetermined angle ranges from greater than about 0 to about 135 degrees, preferably about 5 to about 85 degrees, more preferably about 20 to about 70 degrees, and most preferably about 25 to about 60 degrees. (In the case of multiple areas of attachment extending from the ball-attaching means and mating on the outer surface of the ball, the centroid of the areas of attachment can be a vector center. For example, when three areas of attachment, within the same hemisphere or quadrasphere of the ball, are located at or about the vertices of a equilateral triangle, the centroid is located at or about equidistant from the vertices. In the case of a square or rectangle, the centroid is located at or about the intersection of the diagonals.) The suspension angle is predetermined and set by the user (e.g., player or striker) prior to impact of the ball. The variable positioning of counterweight 38 can control the predetermined angle of suspension. Also, the predetermined angle of suspension can be controlled by angle-adjusting means incorporated into either the support means or the pivotable attachment arm ass'y. Angle-adjusting means can be adapted for the connecting means and/or the ball-attaching means in the pivotable attachment arm ass'y 30, such as relatively rigid, yet bendable material (e.g., flexible metal conduit) in arm 33 and dampener 32, and hinges, dials, set screws, and the like, to change the angle of a single or multiple piece arm 33 or dampener 32 relative to the ball when it is attached.

FIG. 7 shows pivotable attachment arm ass'y 30 at a predetermined suspension angle A of bout 45 degrees with c'weight 38 being turned clockwise on right-hand threads to its nearest distance to pivot 35. This creates the desired orientation for hitting at least partially on the top area of volleyball 20, i.e., over the top, normally within a contact area 95 encompassing a less-than-hemispherical area of the outer surface of the ball, thus causing a relatively short, acute downward trajectory (e.g. less than about 60 degrees below the horizon).

Figure 8:
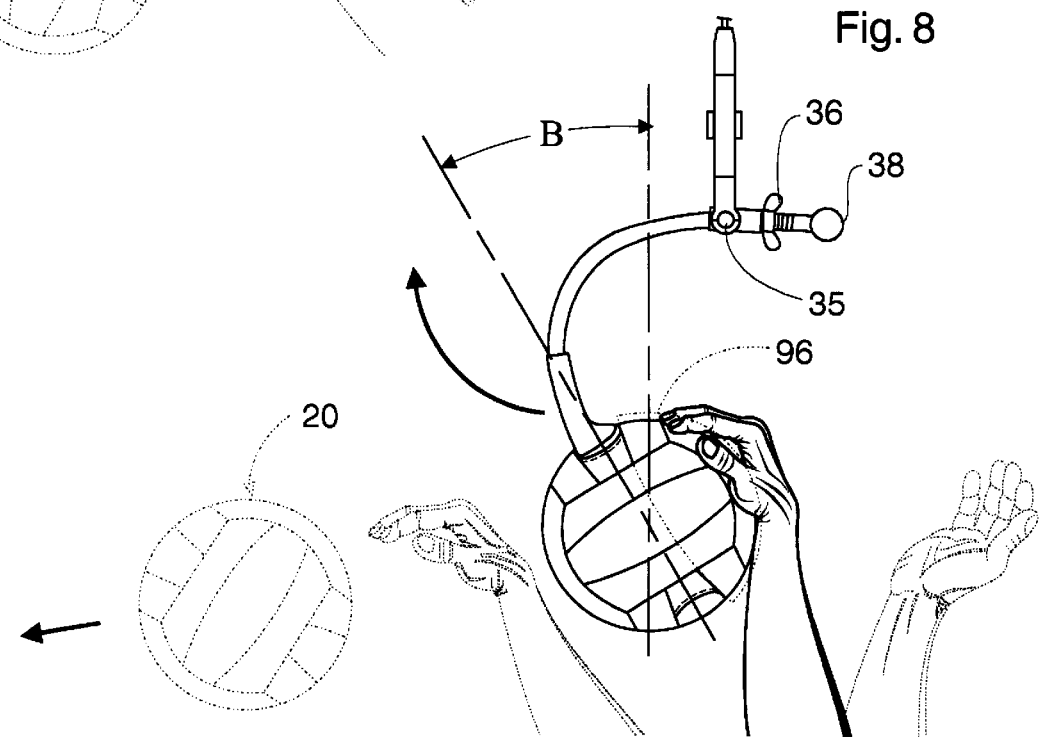
FIG. 8 shows a side view of a volleyball, an attachment arm ass'y, and a sheave ass'y, including a volleyball striker's hand and volley displacement.

FIG. 8 shows pivotable attachment arm ass'y 30 at a predetermined suspension angle B of about 30 degrees with counterweight 38 being turned counter clockwise on right-hand threads to its farthest distance from pivot 35. This creates the desired orientation for hitting on a contact area 96 encompassing a vertically oriented, less-than-hemispherical area of the side of volleyball 20, causing a relatively longer more horizontal trajectory (and even obtuse trajectories, particularly in other sports such as baseball or softball). The adjustability of the suspension angle allows the hitter to manipulate the device for the least amount of resistance, particularly through the striking or contact zone, when impacting volleyball 20. This feature permits the spike trainer to achieve a high degree of safety (such as reduced risk of injury to player back muscles, etc.) while maintaining a realistic feel.

Figure 9:
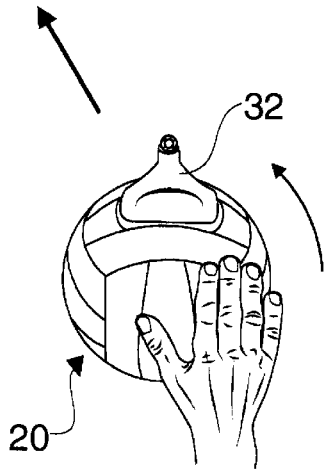
FIG. 9 shows a front view of a volleyball, an attachment arm ass'y, and a sheave ass'y.
Figure 9:
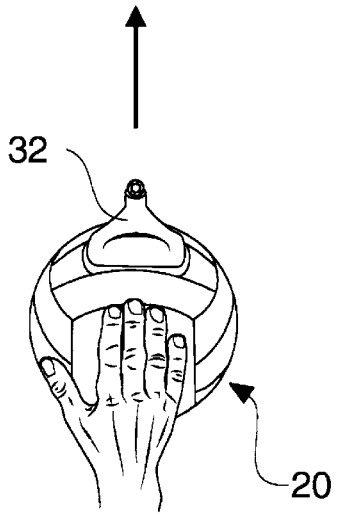
Figure 9:
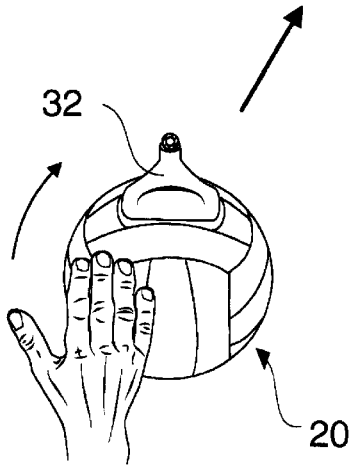
Figure 9:
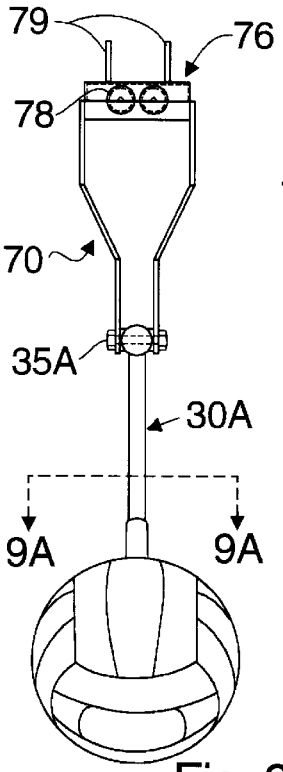

FIG. 9 illustrates a modified and more preferred embodiment of the sheave assembly shown in FIGS. 4 and 4-X. Sheave assembly 70 of FIG. 9 illustrates a height adjusting means connectable to the remainder of the support via an upper sheave apparatus 76 containing pulley 78 and cord 79 located above the swing path of attachment means such as a rotating pivotable attachment arm ass'y 30A (similar to that of FIG. 3-X) after ball impact and ball release. Sheave assembly 70 provides lower located orifices 36L an 36R in which a pivot such as bolt pivot 35A through attachment arm ass'y 30A can rotate about a 360 degree range and thus allow the pivotable attachment arm and its ball-attaching means including the dampener and ball-attaching plate to travel freely and unhindered through a 360 degree arc between sufficiently separated sheave side enclosures 72 and 74 that connect the upper sheave apparatus with the lower orifices that also provide a fulcrum for the pivotable attachment arm ass'y 30A. Of course, bolt pivot 35A and orifices 36L and 36R can be substituted with alternative or equivalent pivot means including a ball and socket, and the like. Also, a bolt pivot, or other equivalents, can pass through an integral part of the attachment arm 30A, such as perpendicularly oriented rod 35B (with respect to arm 30A) shown as a detached part of FIG. 9-B. Such an integrated pivot rod 35B, having an orifice 35C therethrough, can fit between orifices 36L and 36R of sheave side enclosures 74 and 72, respectively, so that a bolt pivot can pass through the aligned orifices to allow movement (rotation) freely about a central longitudinal axis of a pivot bolt through an arc of at least 10, preferably at least 30, and most preferably at least 360 degrees, typically as a result of ball impact, release and displacement.

Trajectory variations may also be coupled with different manipulations of volleyball spin similar to that of baseball pitchers. Note: Directional descriptions such as left or right are in reference to the hitter's point of view. FIGS. 9-A1, A2, A3 show contact points, ball rotation, and their initial trajectories. FIG. 9-A1 shows contact of volleyball 20 through the right side, creating a counter clockwise spin, about an essentially vertical axis, that causes the ball to curve left. FIG. 9-A2 shows contact of volleyball 20 over the top and through the middle, creating a forward spin, about a horizontal axis, that causes volleyball 20 to sink. FIG. 9-A3 shows contact of volleyball 20 through the left side, creating a clockwise spin, about an essentially vertical axis, that causes the ball to curve right. The full trajectories of FIGS. 9-A1, A2, and A3, respectively, are indicated by long arrows A1, A2, and A3, respectively, in FIG. 10 within a volleyball court's boundary 93. When executing spin on volleyball 20 in FIGS. 9-A1 and 9-A3, the hand-arm swing path actually approaches and continues past the side of volleyball 20. The spike trainer facilitates the practice of these methods by providing a clear unobstructed swing path at the sides and top.

Accordingly, the spike trainer of the invention provides a lightweight, easy loading, realistic-feeling device that encourages persons of almost any age to safely practice and improve upon the various techniques of striking a volleyball or propelling several other sport balls such as a baseball, softball or soccer ball. The inventive device can include a plurality of magnetic balls and various accessories to help a player achieve an efficient workout by himself/herself or with an entire team.

While the above description contains many specificity's, these should not be construed as limitations on the scope of the invention, but rather as an exemplification of one or more preferred embodiment(s) thereof. Other variations are possible. For example, the arm attachment assembly can be pivotably retained from a variety of frame types. In one frame type, a fold out frame may be mounted to a wall, with a net backdrop that returns the ball, thus creating a spiking cage for off-court warm-ups. Another configuration employs a mobile (e.g., wheeled) cart with a boom extending upward suspending the ball anywhere on the court: at the net, behind the 10 foot line, or at the serving line. This cart could also have the net attachment and could then be alternately used as a mobile spiking cage. Still another configuration would utilize a collapsible, lightweight plastic frame that could be bagged and carried to a beach or park and mounted to a net support pole. Yet another configuration would utilize a horizontal rod hung from the ceiling retaining a plurality of pivoting arm assemblies at the net for team drills whereby a plurality of hitters can spike the ball. Furthermore, such volleyball-related configurations, such as the mobile cart, fold-up frame and spiking cage, can be readily modified or adapted for use in baseball, softball, basketball or soccer.

Accordingly, the scope of the invention should not be limited by the embodiment(s) illustrated, but defined by the appended claims and their equivalents.

I claim:

1. A sports training apparatus comprising:

a substantially spherical shaped ball having a striking portion;

an attachment fixture releasably attached to said ball at a location generally distal from said striking portion, wherein said attachment fixture allows supported displacement of said ball, and a support for said ball during said displacement when said support is attached to said attachment fixture, and wherein said support comprises a pivotable arm having a ball attachment end attachable to said attachment fixture and a counterweight end distal from said ball attachment end and a floor stand attached to said pivotable arm, said floor stand capable of supporting said ball in a pre-struck position.

2. The apparatus of claim 1 wherein said floor stand allows height adjustment of said ball.

3. The apparatus of claim 2 wherein said attachment fixture is releasable by striking said ball.

4. The apparatus of claim 3 wherein said attachment fixture comprises a magnet.

5. The apparatus of claim 4 wherein said ball comprises a volleyball.

6. The apparatus of claim 5 wherein said pivotable arm capable of rotating about an arc of at least 360 degrees after said displacement from said pre-struck position to said struck position.

7. The device defined in claim 1 wherein said attachment fixture is selected from the group consisting of magnet, hook and/or loop, suction cup, pneumatic cartridge and tube, handsqueeze pump and tube, releasable tacky surface, forced-air levitation, snap fastener, plug and orifice, linear fastener, and magnetic levitation.

8. A sports ball device comprising:

a ball having a substantially spherical outer surface, retaining means attached to said ball for holding said ball and for releasing said ball from an area of attachment suspended above a floor, said area of attachment comprising an attachment arm having a ball-attaching end comprising a magnetic surface, and a sheave assembly attached to said attachment arm, said sheave assembly capable of raising and lowering said attachment arm.

9. The device defined in claim 8 comprising a substantially gas centered ball.

10. The device defined in claim 9 wherein said gas centered ball is selected from the group consisting of a volleyball, a basketball, a tennis ball and a soccer ball.

11. The device defined in claim 8 comprising a substantially solid centered ball.

12. The device defined in claim 1 wherein said solid centered ball is selected from the group consisting of a baseball and softball.

13. The device defined in claim 1 wherein said retaining means comprises a flexible magnet.

14. The device defined in claim 8 wherein said area of attachment comprises said attachment arm having a pivotable portion adapted for attachment to support means for suspending said ball.

15. The device defined in claim 14 wherein said ball-attaching end is capable of mating with a sufficient portion of said retaining means fixedly attached to a minor portion of said outer surface of said ball.

16. The device defined in claim 15 wherein said minor portion comprises less than about 25 percent of said outer surface.

17. The device defined in claim 8 wherein said retaining means is capable of substantially contouring with at least a portion of a ball-attaching surface of said ball-attaching end of said attachment arm.

18. The device defined in claim 8 wherein said retaining means is capable of holding and releasing said ball at a predetermined suspension angle is from about 5 to about 85 degrees from vertical.

19. The device defined in claim 18 wherein said suspension angle is from about 20 to about 70 degrees from vertical.

20. The device defined in claim 18 wherein said suspension angle is from about 25 to about 60 degrees from vertical.

21. The device defined in claim 8 wherein retaining means is capable of releasing said ball when impacted with a manual force greater than a force holding said ball, said manual force from about 0.1 to about 350 p.s.i.g.

22. The device defined in claim 8 wherein said ball comprises a volleyball and said retaining means is capable of holding at least the weight of said volleyball against earth gravitational force.

23. A method for striking the sports ball of claim 8.

24. A volleyball device comprising:

a volleyball and retaining means fixedly attached to said volleyball (a) for holding said volleyball and (b) for releasing said volleyball upon manual impact, and a pivotable attachment arm adapted for mating with and releasing from said retaining means, wherein the weight of said volleyball is adapted for holding against earth gravitational force from an area of attachment suspended by a support above a floor, said retaining means fixedly attached to a minor portion of the upper 75 percent of the outer surface of said volleyball when held in a pre-struck position relative to vertical, wherein said retaining means is capable of mating with and releasing from a pivotable attachment arm adapted for pivoting about said support at or about said area of attachment, and wherein the centroid of said area of attachment is adapted for contact with the centroid of said retaining means on said volleyball at a suspension angle of about 5 to about 85 degrees from vertical.

25. The device defined in claim 24 wherein said retaining means comprising a flexible magnet attached to a minor portion of the outer surface of said volleyball.

26. The device defined in claim 25 wherein said magnet is attached to said volleyball within or about at least one panel of said whole outer surface of said volleyball.

27. The device defined in claim 24 wherein said minor portion comprises from about 1 to less than about 25 percent of said outer surface of said volleyball.

28. The device defined in claim 24 wherein said retaining means comprising a hook and/or loop material attached to a minor portion of the outer surface of said volleyball.

29. A method for striking a volleyball employing the device of claim 24.

30. A volleyball device comprising a volleyball and at least one flexible magnetic strip fixedly attached on at least a portion of the surface of said volleyball, and a pivotable attachment arm adapted for mating with and releasing from said flexible magnetic strip, said pivotable attachment arm having a ball attachment end attachable to said flexible magnetic strip and a counterweight end distal from said ball attachment end.

31. The device defined in claim 30 wherein at least two magnetic strips are fixedly attached to said outer surface of said volleyball.

32. The device defined in claim 30 wherein said volleyball capable of being sufficiently held to said pivotable attachment arm and released from said pivotable attachment arm upon manual impact force greater than the weight of said volleyball and said flexible magnet strip.

33. The device defined in claim 30 wherein said flexible magnetic strip contoured with a portion of the circumference of said volleyball.

34. The device defined in claim 30 wherein said flexible magnetic strip comprising magnetic powder containing strontium components or barium ferrite components in a vinyl binder.

35. A method for striking a volleyball employing the device of claim 30.

36. A pivotable attachment arm adapted for retaining a ball and releasing said ball upon impact force, said attachment arm comprising:

ball-attaching means for holding and releasing a ball, said ball comprising fixedly attached retaining means for holding said ball to said ball-attaching means and releasing said ball from said ball-attaching means upon sufficient impact to overcome said holding of said ball, pivotable means for pivoting said ball-attaching means about a support adapted for suspending said ball attached by said retaining means and said ball-attaching means an adjustable distance above a floor, said pivotable means capable of multidirectional rotation about said support and adapted for connection to a sheave assembly capable of raising and lowering said arm, said sheave assembly connected to said support, and connecting means for connecting said ball-attaching means to said pivotable means.

37. The arm defined in claim 36 further comprising counterbalancing means connected to said pivotable means for balancing the weight of said ball at a predetermined suspension angle relative to vertical.

38. The arm defined in claim 36 wherein said ball comprises a volleyball.

39. The arm defined in claim 36 wherein said connecting means adapted to span an arc of about 100 to about 150 degrees about a radius of about 2 to about 12 inches between said ball-attaching means and said pivotable means.

40. The arm defined in claim 39 wherein said connecting means comprising connecting material selected from the group consisting of metal-containing tubing, injection molded plastic, machined plastic and hardwood.

41. The arm defined in claim 36 wherein said ball-attaching means comprises a iron-containing metal surface having a shape matable with said retaining means of said ball.

42. A method for striking a ball employing the arm of claim 36.

43. An attachment arm adapted for holding a volleyball against earth gravitational force and capable of releasing said volleyball upon impact force greater than said force required for said holding, said attachment arm comprising:

ball-attaching means for holding and releasing a volleyball having fixedly attached retaining means for holding and releasing said volleyball, pivotable means adapted for allowing movement of said ball-attaching means and for allowing attachment to a support suspending said volleyball above a floor, connecting means for connecting said ball-attaching means to said pivotable means, and a sheave assembly attached to said pivotable means for adjusting the height of said volleyball.

44. The arm defined in claim 43 further comprising counter balancing means connected to said pivotable means for balancing the weight of said volleyball at a predetermined suspension angle relative to vertical.

45. The arm defined in claim 43 wherein said connecting means adapted to span an arc of about 100 to about 150 degrees about a radius of about 2 to about 12 inches between said ball-attaching means and said pivotable means.

46. A method for striking a volleyball employing the arm of claim 43.

47. A device including a volleyball, a support and a pivotable attachment arm, said device comprising:

a volleyball having a magnetic material fixedly attached to a portion of said volleyball;

a pivotable attachment arm having a ball-attaching end, a fulcrum, and a counterweight end, said ball-attaching end adapted for holding and releasing said volleyball, said counterweight end having sufficient weight to maintain the centroid of said ball-attaching end in contact with said magnetic material at a predetermined suspension angle formed between the upward vertical central ray of said volleyball and the central ray of said volleyball passing through said centroid, said ball-attaching end adapted for releasing said volleyball when sufficient force is applied to said volleyball to overcome the holding force of said magnetic material; and a support connected to said pivotable attachment arm at or about said fulcrum, said support adapted for suspending said volleyball an adjustable distance above a floor.

48. The device defined in claim 47 wherein said ball-attaching end and said fulcrum are separated by a distance sufficient to allow a hand applying said force to the outer surface of an upward oriented hemisphere of the outer surface of said volleyball to not contact said counterweight end and said pivotable portion when a path of said hand is substantially aligned with a plane passing through said ball-attaching end, said counterweight end and said fulcrum portion.

49. The device defined in claim 47 wherein said ball-attaching end and said fulcrum are separated by at least about one inch.

50. The device defined in claim 47 wherein said ball-attaching end comprises an area of attachment mating with said outer surface of said volleyball at or about said magnetic material at said predetermined suspension angle of greater than zero to less than about 135 degrees from vertical.

51. The device defined in claim 50 wherein said predetermined suspension angle is about 10 to about 70 degrees from vertical.

52. The device defined in claim 50 wherein said predetermined suspension angle is about 25 to about 60 degrees from vertical.

53. The device defined in claim 47 further comprising a sheave assembly portion of to said support comprising said fulcrum, said pivotable portion adapted for rotation about said sheave assembly, said sheave assembly adapted for adjusting said adjustable distance from said floor.

54. The device defined in claim 53 wherein said sheave assembly adapted for said pivotable attachment arm to rotate 360 degrees about said fulcrum.

55. A method for striking a volleyball employing the device of claim 47.

56. A device for practicing striking a ball including a floor, a support, a pivotable attachment arm, and a ball, said device comprising:

said ball comprising retaining means fixedly attached to a minor portion of the whole out surface of said ball for holding said ball against earth gravitational force and for releasing said ball from said pivotable attachment arm suspended above said floor, said pivotable attachment arm comprising (1) ball-attaching means for holding and releasing said ball from said retaining means, (2) pivotable means for pivoting said ball-attaching means about said support and (3) connecting means for connecting said ball-attaching means and said pivotable means, and said support connected to said pivotable means and adapted for suspending said ball an adjustable distance above said floor, said support comprising a sheave assembly adapted for providing a fulcrum for said pivotable means and adapted for adjusting said adjustable distance of said ball from said floor.

57. The device defined in claim 56 wherein said ball-attaching means substantially mates with said outer surface of said ball at or about said retaining means, said retaining means comprising magnetic material.

58. The device defined in claim 56 wherein said pivotable attachment arm further comprising counterbalancing means for balancing said ball-attaching means to maintain a predetermined suspension angle from vertical with a central ray of said ball extending from said ball through the centroid of said ball-attaching means.

59. The device defined in claim 48 wherein said predetermined suspension angle is about 0 to about 135 degrees.

60. The device defined in claim 59 wherein said ball is a volleyball and said predetermined suspension angle is about 25 to about 60 degrees.

61. The device defined in claim 56 wherein said ball-attaching means is adapted to maintain a predetermined suspension angle from vertical with a central ray of said ball extending from said ball through the centroid of said ball-attaching means in the range from about 5 to about 85 degrees and said sheave assembly adapted for permitting said pivotable attachment arm to rotate at least 360 degrees about said fulcrum.

62. The device defined in claim 61 wherein said pivotable attachment arm further comprises angle-adjusting means for controlling said suspension angle.

63. The device defined in claim 62 wherein said ball is a volleyball and said predetermined angle is about 25 degrees to about 75 degrees.

64. A method for striking a ball employing the device of claim 56.

* * * * *